US005597338A

United States Patent [19]

Iwai et al.

[11] Patent Number: 5,597,338

[45] Date of Patent: Jan. 28, 1997

[54] METHOD FOR MANUFACTURING SURFACE-CONDUCTIVE ELECTRON BEAM SOURCE DEVICE

[75] Inventors: Kumi Iwai, Isehara; Ichiro Nomura, Atsugi; Tetsuya Kaneko, Yokohama, all of Japan

[73] Assignee: Canon Kabushiki Kaisha, Tokyo, Japan

[21] Appl. No.: 532,545

[22] Filed: Sep. 25, 1995

Related U.S. Application Data

[62] Division of Ser. No. 24,435, Mar. 1, 1993, abandoned.

[51] Int. Cl.[6] ..... H01J 9/00; H01J 9/02

[52] U.S. Cl. ..... 445/51; 445/35; 445/46; 427/77; 427/78; 313/495; 313/309; 313/310

[58] Field of Search ..... 313/309, 336, 313/351, 495, 496, 497, 422; 445/35, 36, 46, 50, 51; 427/77, 78, 124, 125, 126.3, 255.2, 255.3, 272.2, 374.1, 379

[56] References Cited

U.S. PATENT DOCUMENTS

| | | | |
|---|---|---|---|
| 3,855,499 | 12/1974 | Yamada et al. | 313/351 |
| 3,935,500 | 1/1976 | Oess et al. | 313/495 |
| 4,618,801 | 10/1986 | Kakino | 313/495 |
| 5,015,912 | 5/1991 | Spindt et al. | 313/497 X |
| 5,023,110 | 6/1991 | Nomura et al. | 427/49 |
| 5,066,883 | 11/1991 | Yoshioka et al. | 313/309 |
| 5,155,416 | 10/1992 | Suzuki et al. | 313/422 |
| 5,285,129 | 2/1994 | Takeda et al. | 313/309 X |

FOREIGN PATENT DOCUMENTS

| | | |
|---|---|---|
| 4-28139 | 1/1992 | Japan . |

*Primary Examiner*—Nimeshkumar Patel

*Attorney, Agent, or Firm*—Fitzpatrick, Cella, Harper & Scinto

[57] ABSTRACT

A surface-conductive electron beam source having a fine particle film which is formed by repeating a film formation step of applying and calcining an organic metal compound solution several times. A pair of electrodes come in contact with the fine particle film, and an electron-emitting portion is formed at a part of the fine particle film. There is also a display device having the electron beam source, a modulation means for modulating an electron beam emitted from the electron beam source in accordance with an information signal, and an image-forming member for forming an image by the irradiation of the electron beam.

21 Claims, 5 Drawing Sheets

METHOD FOR MANUFACTURING SURFACE-CONDUCTIVE ELECTRON BEAM SOURCE DEVICE

This application is a division of application Ser. No. 08/024,435 filed Mar. 1, 1993, now abandoned.

BACKGROUND OF THE INVENTION

1. Field of the Invention

The present invention relates to a surface-conductive electron beam source and a method for manufacturing the same, and particularly, it relates to a display device equipped with the electron beam source having an electron-emitting portion.

2. Related Background Art

FIG. 8 shows the constitution of a surface-conductive electron-emitting device having a pair of electrodes disposed with the interposition of an electrode gap. In this drawing, reference numeral 4 is a substrate made of quartz, numerals 1 and 2 are electrodes formed on the substrate 4, and 6 is an electrode gap. Numeral 3 denotes an electron-emitting portion. In this conventional electron-emitting element, the electron-emitting portion 3 is formed on a fine particle film in the electrode gap 6. However, among such conventional electron-emitting elements, values of emission current scatter, and therefore industrial problems are present at the time of the mass production of these devices. In a display device in which a plurality of such devices are arranged and images are depicted with electrons emitted therefrom, the scatter of the emission current in the respective devices directly gives rise to the scatter of luminance, which leads to the deterioration of the quality of the display.

In addition U.S. Pat. No. 5,066,883 and U.S. Pat. No. 5,023,110 of the applicant of the present application can be enumerated as conventional prior art of the device.

The scatter of the emission current is caused by various factors, but the present invention intends to provide a solution means which comprises inhibiting the scatter of film resistance properties.

As the factors in connection with of the scatter of the film resistance properties, there can be considered some factors regarding film quality such as adhesive properties of the film, unevenness of film thickness, presence of film defects and nonuniform distribution of fine particles.

SUMMARY OF THE INVENTION

An object of the present invention is to provide an electron beam source in which the scatter of the emission current is inhibited by improving the quality of the film.

Another object of the present invention is to provide a display in which the scatter of luminance attributable to that of the emission current is inhibited.

The first aspect of the present invention is directed to a surface-conductive electron beam source which comprises a fine particle film formed by repeating a film formation step of applying and calcining an organic metal compound solution a number of times, a pair of electrodes coming in contact with the fine particle film, and an electron-emitting portion formed at a part of the fine particle film.

The second aspect of the present invention is directed to a surface-conductive electron beam source which comprises a plurality of paired electrodes arranged on a substrate, fine particle films coming in contact with the paired electrodes, the fine particle films being formed by repeating a film formation step of applying and calcining an organic metal compound solution a number of times, and electron-emitting portions formed at parts of the fine particle films.

The third aspect of the present invention is directed to a display device which comprises one of the above-mentioned electron beam sources, a modulation means for modulating an electron beam emitted from the electron beam source in accordance with an information signal, and an image-forming member for forming an image by the irradiation of the electron beam.

The fourth aspect of the present invention is directed to a display device which comprises one of the above-mentioned electron beam sources and an image-forming member for forming an image by the irradiaion of the electron beam.

The fifth aspect of the present invention is directed to a method for forming a surface-conductive electron beam source comprising a fine particle film and a pair of electrodes coming in contact with the fine particle film which comprises the steps of repeating a film formation step of applying and calcining an organic metal compound solution plural times to form the fine particle film, and then applying voltage to the fine particle film to form an electron-emitting portion.

The sixth aspect of the present invention is directed to a display method using the above-mentioned display device which comprises the following steps:

(1) a step of emitting an electron beam from an electron beam source, (2) a step of modulating the electron beam in accordance with an information signal, and (3) a step of forming an image by the irradiation of the electron beam.

DETAILED DESCRIPTION OF THE PREFERRED EMBODIMENTS

Now, the present invention will be described in detail in reference to steps of one embodiment of the present invention.

The term "fine particle film" in the present invention means a film consisting of an aggregation of plural fine particles, which aggregation implies a condition where the particles adjoin to each other, or overlap with each other, or constitute insular agglomerates, as well as a condition where particles are separately located dispersedly.

Figure 1A:
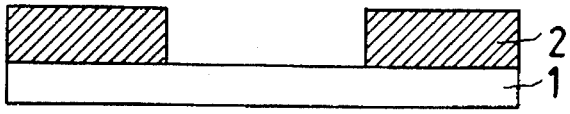
FIGS. 1A through 1E are schematic sectional views illustrating a process of the plane type surface-conductive electron beam source device of the present invention.

In the first place, as shown in FIG. 1A, a pair of electrodes 2 are formed with the interposition of a predetermined space on a substrate 1 of quartz or the like.

Figure 1B:
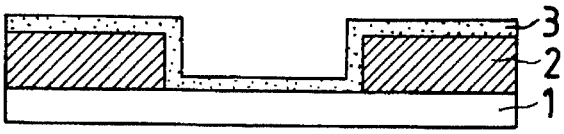

Next, as shown in FIG. 1B, an organic metal compound solution such as a butyl acetate solution of an organic palladium complex is applied and then calcined. Similarly, the application and the calcination are further repeated to form a fine particle film as shown by reference numerals 3 and 4 in FIG. 1C. Although the applied and calcined layer is expressed by two layers 3 and 4 in the figure so as to clarify that the application and calcination step is carried out plural times, the substantially obtained layers constitute a uniform fine particle film.

Figure 1C:
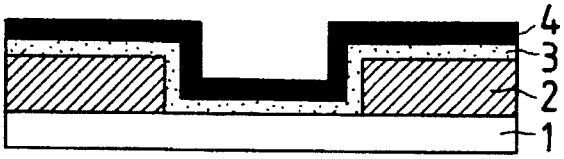
Figure 1D:
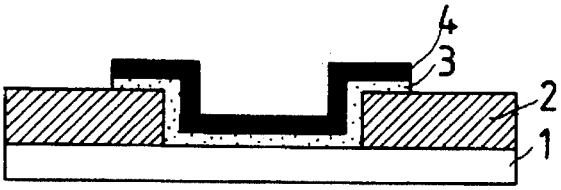
Figure 9:
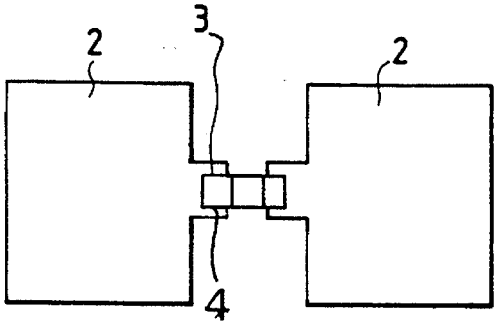
FIG. 9 is a partial top view of FIG. 1D.

Afterward, unnecessary portions of the film are removed therefrom by etching to form a constitutional structure having the pair of electrodes coming in contact with the fine particle film as shown in FIG. 1D and FIG. 9.

Figure 1E:
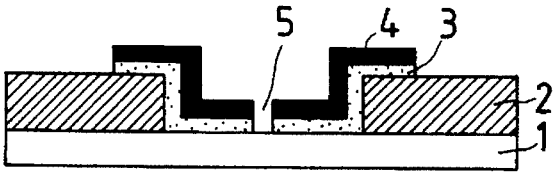

Next, the thus obtained constitutional structure is placed in a vacuum container together with an image-forming member disposed just above the fine particle film, and voltage is then applied, whereby a forming treatment is carried out to form an electron-emitting portion at a part of the fine particle film. After the forming treatment, the structure is taken out of the vacuum container. As the result, such a state as shown in FIG. 1E can be observed.

Figure 2:
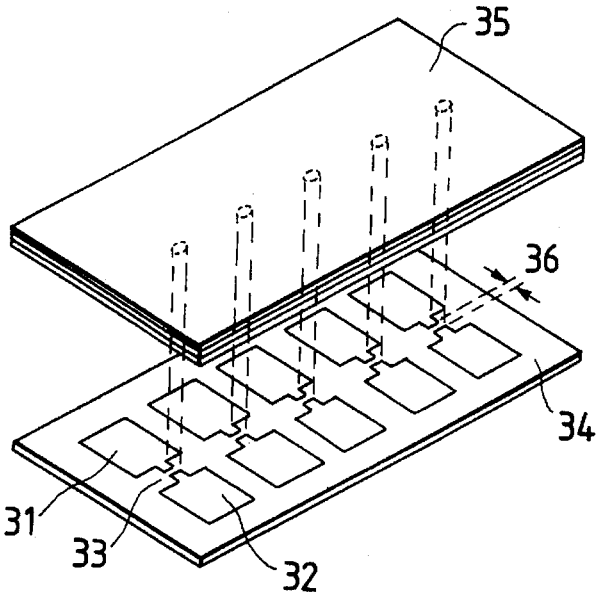
FIG. 2 is a perspective view of one embodiment of the plane type surface-conductive electron beam source devices of the present invention.

FIG. 2 shows another embodiment of a surface-conductive electron beam source of the present invention. In this drawing, reference numeral 33 is a fine particle film including the electron-emitting portion, numeral 34 is a substrate, numerals 31 and 32 are a plurality of paired electrodes arranged on the substrate. Each of the paired electrodes is located at intervals of gap 36. 35 is a face plate having a fluorescent member. The respective paired electrodes come in contact with fine particle films which are formed by repeating a film formation step of applying and calcining an organic metal compound solution plural times. Each fine particle film has an electron-emitting portion 3 at a part thereof.

According to the above-mentioned procedure, the electron beam source element of the present invention can be formed.

Figure 3:
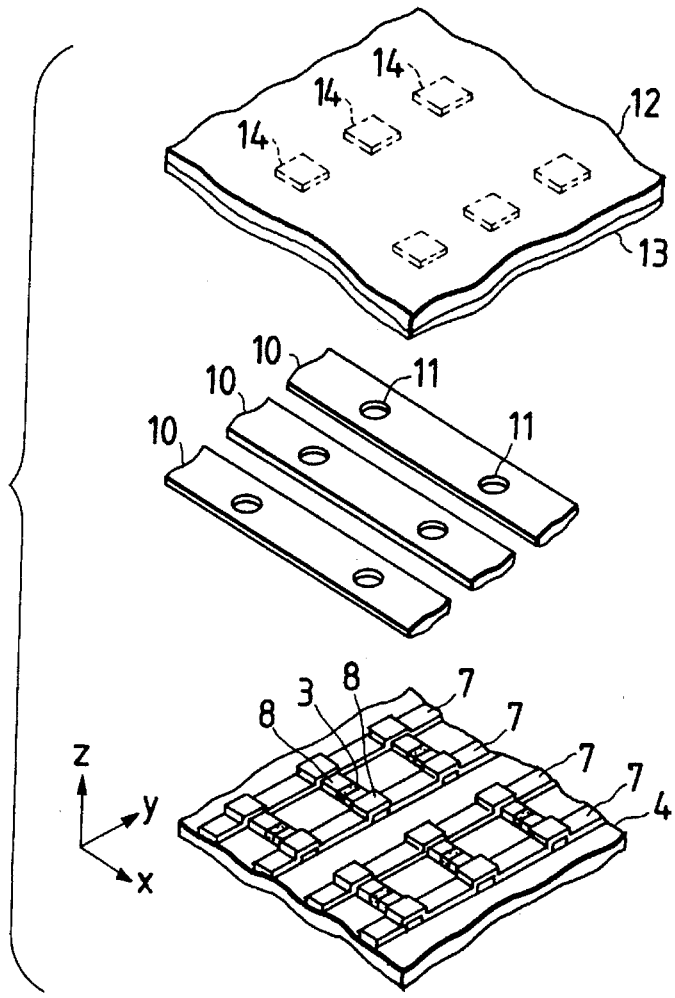
FIG. 3 is a perspective view of one embodiment of the display devices formed by arranging the electron beam source devices of the present invention.

Furthermore, as shown in FIG. 3, the devices of the present invention can be arranged so as to form a display device. In this drawing, reference numeral 4 is a substrate, numeral 7 is an electrode wire, numeral 8 is an element electrode, 3 is an electron-emitting portion, 10 is a grid electrode, 11 is an electron passage orifice, 12 is an image-forming plate, and 13 is a fluorescent member. This fluorescent member 13 can fluoresce when an electron collides against it. Numeral 14 is a luminous point of the fluorescent member 13. In this display device, each linear electron source is formed by arranging electron-emitting devices in parallel between the two electrode wires 7, and the linear electron sources and the grid electrodes 10 carry out XY matrix drive, whereby electrons collide against the fluorescent member 13 on the image-forming plate 12 to form an image.

The substrate can be made of an insulating material such as glass or quartz.

The paired electrodes can be made of a metal such as nickel, aluminum, Cu, Au, Pt or Ag; $SnO_2$, $In_2O_3$, or indium tin oxide, and they can be formed by a vacuum deposition method or the like.

A paired electrode gap may be from 0.1 to 100 μm.

Examples of an organic metal compound which can be used in the organic metal compound solution include an organic palladium complex, an organic platinum complex and an organic ruthenium complex.

Such an organic metal compound solution can be applied by dipping or spin coat.

In repeating a film formation step of applying and calcining the organic metal compound solution plural times in accordance with the present invention, the concentration of the organic compound solution may be altered at or may not altered every application step.

The electron-emitting portion regarding the present invention can be formed by a forming treatment which utilizes the application of the above-mentioned usual voltage or the application of pulse voltage. A procedure of pulse-forming described in Japanese Patent Application Laid-Open No. 4-28139 can be employed as the forming treatment utilizing the pulse voltage.

Figure 4:
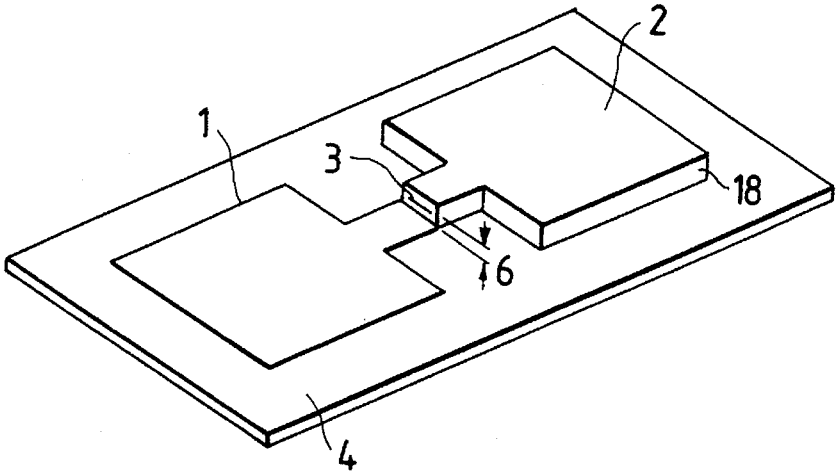
FIG. 4 is a perspective view of one embodiment of the vertical type surface-conductive electron beam source devices of the present invention.

The plane type surface-conductive electron-emitting device has now been described above as the constitution of the electron beam source device of the present invention, but a vertical type surface-conductive electron-emitting device as shown in FIG. 4 is also one practicable embodiment of the present invention. In this drawing, reference numerals 1 and 2 are electrodes, numeral 3 is an electron-emitting portion, 4 is a substrate, 6 is an electrode gap, and 18 is a step-forming layer. That is, one pair of electrodes 1 and 2 face each other with the interposition of the step, and the electrode gap 6 is present between upper and lower edges of the step-forming layer 18 provided on the substrate 4. On the side of the step which is the electrode gap 6, the electron-emitting portion 3 is formed. In consequence, in the structure of the vertical type surface-conductive electron-emitting device, the same effect as in the plane type can be obtained by applying voltage between the electrodes 1 and 2. The step-forming layer 18 can be made of $SiO_2$, MgO, $TiO_2$, $Ta_2O_3$, $Al_2O_3$, a laminate thereof or a mixture thereof. The electrode gap 6 depends upon the thickness of the step-forming layer 18 and that of the electrodes 1 and 2, but it is preferably from several tens Å to several μm. For the other constitutional members, the same materials and constitutions as described above can be used.

According to the present invention, the above-mentioned organic metal compound solution can be uniformly applied on the substrate and can then be calcined. Therefore, the fine particle film can be obtained which meets requirements such as uniform film adhesive properties, uniform film thickness, less film defects and less nonuniform distribution of fine particles.

That is, in order to form the fine particle film of the present invention, the application and calcination are repeated plural times in the present invention. As a result, the poor film adhesive properties, the nonuniform film thickness and the nonuniform distribution of the fine particles, which occur in the case of one operation of the application and calcination, can be rectified, and the film defects can also be reduced. One main cause of these effects can be considered to be that the wetting properties of the film in the second application and calcination of the organic metal compound solution are improved owing to the presence of the film formed by the preceding application and calcination.

Now, the present invention will be described in more detail in reference to examples, but the scope of the present invention should not be limited to these examples.

EXAMPLE 1

Figure 5:
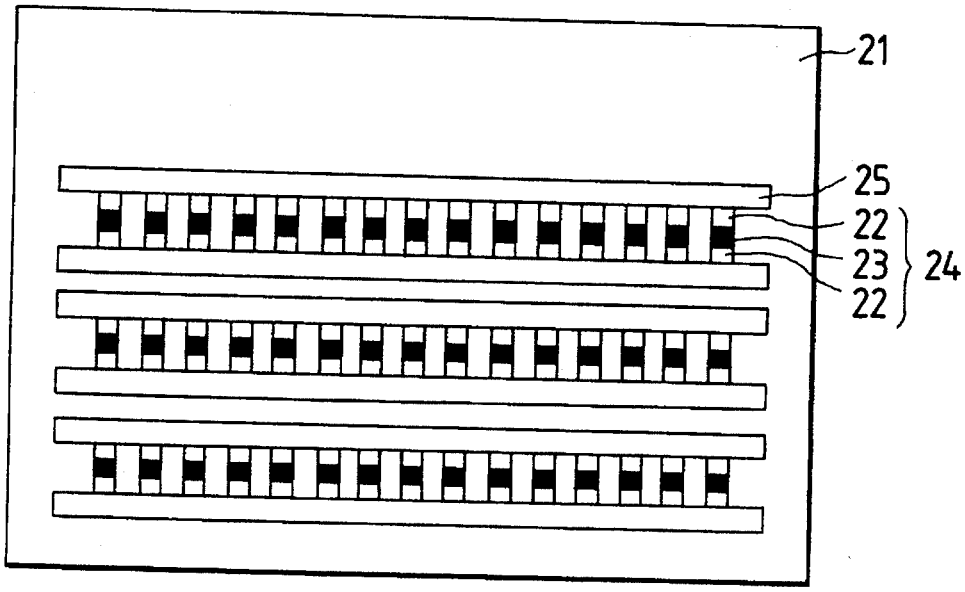
FIG. 5 is a top view of one embodiment of multiply arranged plane type surface-conductive electron beam source divices of the present invention.

In accordance with the present invention, a multiply arranged plane type surface-conductive electron beam source device (15×3) was formed as shown in FIG. 5.

In FIG. 5, numeral 21 is a substrate, 24 is an electron beam source portion consisting of device electrodes 22 and electrode gap portion 23, and 25 is a wiring electrode. The electrode gap portion 23 in the figure corresponds to a fine particle film portion lying between electrodes 2 and including electron-emitting portion 5 in FIG. 1E.

The principal parts of the process of Example 1 is explained in the following, referring to FIGS. 1A through 1E and FIG. 9.

In the first place, a pair of electrodes were formed, by a photolithography technique and a vacuum film formation technique which were usually often used, quartz substrate 21 which was sufficiently degreased and washed.

An electrode gap was 2 μm, and an electrode width was 300 μm.

The material of the electrodes was 950-Å-thick nickel having a 50-Å-thick chromium under-film, and these electrodes were formed by a vacuum deposition method as shown in FIG. 1A.

An organic palladium complex solution containing 10 g/l of Pd (trade name Catapaste CCP, made by Okuno Chemicals Co., Ltd.) was applied to the above-mentioned substrate by the use of a spin coater, followed by calcination at 300° C. for 13 minutes as shown in FIG. 1B. Here, the thickness of the fine particle film was measured by α-step 2, and as a result, it was apparent that the film thickness was about 35 Å.

Similarly, the organic palladium complex solution containing 10 g/l of Pd was further applied thereto by the use of the spin coater, followed by calcination at 300° C. for 13 minutes as shown in FIG. 1C.

Next, dry etching was carried out using a resist as a mask to obtain a pattern as shown in FIGS. 1D and 9. In FIG. 9, numerals 3 and 4 are fine particle film respectively, and 2 is a pair of electrodes.

The thickness of the thus obtained fine particle films was measured by α-step 2 and a scanning electron microscope (SEM), and as a result, it was apparent that the films had a uniform thickness of about 70 Å.

In order to evaluate the scatter of the resistance of the thus obtained fine particle films, a voltage of 2 V was applied between the electrodes and flowing current was measured. As a result, the resistance values of all the devices were in the range of R=2.8±0.5 kΩ.

Next, a fluorescent member was disposed just above the devices at an interval of about 3 mm, and the substrate having them thereon was placed in a vacuum container of about $10^{-6}$ Torr. First, a pulse voltage of 14 V was applied between the electrodes to carry out a forming treatment. Next, in order to inspect electron-emitting properties, a voltage of 14 V was applied between the electrodes and a voltage of 1 kV was then applied to the substrate having the disposed fluorescent member to measure emission current. As a result, it was apparent that the emission current Ie was 1.8±0.5 μA, and thus the scatter of the emission current was smaller than that in comparative example 1 described later where the process was comprised of treatment of applying and calcinating at one time and the same film thickness was obtained, as in the case of the above-mentioned resistance values.

After the evaluation of the electrical properties, the substrate was taken out from the vacuum container, and the fine particle films were observed through a microscope. As a result, a clear-cut crack was observed on the fine particle film substantially in the middle of the electrodes of each device as shown in FIG. 1E.

EXAMPLE 2

In accordance with the present invention, a plane type surface-conductive electron beam source device as shown in FIG. 2 was formed which comprised five linearly arranged devices. In the present working example, substrate 34 as shown in FIG. 2 is a quartz substrate.

The principal parts of the process of Example 2 is explained in the following, referring to FIGS. 1A through 1E and FIG. 9.

In the first place, a pair of electrodes were formed, by a photolithography technique and a vacuum film formation technique which were usually often used, on a 1 inch×1.5 inch quartz substrate which was sufficiently degreased and washed.

An electrode gap (36 in FIG. 2) was 2 μm, and an electrode width was 300 μm.

The material of the electrodes was 950-Å-thick nickel having a 50-Å-thick chromium under-film, and these electrodes were formed by a vacuum deposition method a shown in FIG. 1A.

An organic palladium complex solution containing 2.2 g/l of Pd (trade name Catapaste CCP, made by Okuno Chemicals Co., Ltd.) was applied to the above-mentioned substrate by the use of a spin coater, followed by calcination at 300° C. for 13 minutes as shown in FIG. 1B.

Similarly, an organic palladium complex solution containing 22 g/l of Pd was further applied thereto by the use of the spin coater, followed by calcination at 300° C. for 13 minutes as shown in FIG. 1C.

Next, dry etching was carried out using a resist as a mask, to obtain a pattern as shown in FIGS. 1D and 9. In FIG. 9, numerals 3 and 4 are fine particle film respectively, and 2 is a pair of electrodes.

The thickness of the thus obtained fine particle films was measured by α-step 2 and SEM, and as a result, it was apparent that the films had a uniform thickness of about 81 Å.

In order to evaluate the scatter of the resistance of the thus obtained fine particle films, a voltage of 2 V was applied between the electrodes and flowing current was measured. As a result, the resistance values of the five devices were in the range of R=2.5 ±0.5 kΩ.

Next, a fluorescent member was disposed just above the devices at an interval of about 3 mm, and the substrate having them thereon was placed in a vacuum container of about $10^{-6}$ Torr. First, a pulse voltage of 14 V was applied between the electrodes to carry out a forming treatment. Next, in order to inspect electron-emitting properties, a voltage of 14 V was applied between the electrodes and a voltage of 1 kV was then applied to the substrate having the disposed fluorescent member to measure emission current. As a result, it was apparent that the emission current Ie was 2.0±0.5 μA, and thus the scatter of the emission current was smaller than that in comparative example 2 described later where the process was comprised of treatment of applying and calcinating at one time and the same film thickness was obtained, as in the case of the above-mentioned resistance values.

After the evaluation of the electrical properties, the substrate was taken out from the vacuum container, and the fine particle films were observed through a microscope. As a result, a clear-cut crack was observed on the fine particle film substantially in the middle of the electrodes of each device as shown in FIG. 1E.

EXAMPLE 3

In accordance with the present invention, a plane type surface-conductive electron beam source device as shown in FIG. 2 was formed which comprised five linearly arranged devices. In the present working example, substrate 34 as shown in FIG. 2 is a quartz substrate.

The principal parts of the process of Example 3 is explained in the following, referring to FIGS. 1A through 1E and FIG. 9.

In the first place, a pair of electrodes were formed, by a photolithography technique and a vacuum film formation technique which were usually often used, on a 1 inch×1.5 inch quartz substrate which was sufficiently degreased and washed.

An electrode gap (36 in FIG. 2) was 2 μm, and an electrode width was 300 μm.

The material of the electrodes was 950-Å-thick nickel having a 50-Å-thick chromium under-film, and these electrodes were formed by a vacuum deposition method as shown in FIG. 1A.

An organic palladium complex solution containing 7 g/l of Pd (trade name Catapaste CCP, made by Okuno Chemicals Co., Ltd.) was applied to the above-mentioned substrate by the use of a spin coater, followed by calcination at 300° C. for 13 minutes as shown in FIG. 1B.

Similarly, the organic palladium complex solution containing 7 g/l of Pd was further applied thereto by the use of the spin coater, followed by calcination at 300° C. for 13 minutes as shown in FIG. 1C.

In addition, the organic palladium complex solution containing 7 g/l of Pd was further applied thereto by the use of the spin coater, followed by calcination at 300° C. for 13 minutes.

Next, dry etching was carried out using a resist as a mask, to obtain a pattern as shown in FIGS. 1D and 9. In FIG. 9, numerals 3 and 4 are fine particle film respectively, and 2 is a pair of electrodes.

The thickness of the thus obtained fine particle films was measured by α-step 2 and SEM, and as a result, it was apparent that the films had a uniform thickness of about 74 Å.

In order to evaluate the scatter of the resistance of the thus obtained fine particle films, a voltage of 2 V was applied between the electrodes and flowing current was measured. As a result, the resistance values of the five devices were in the range of R=2.7±0.5 kΩ.

Next, a fluorescent member was disposed just above the devices at an interval of about 3 mm, and the substrate having them thereon was placed in a vacuum container of about $10^{-6}$ Torr. First, a pulse voltage of 14 V was applied between the electrodes to carry out a forming treatment. Next, in order to inspect electron-emitting properties, a voltage of 14 V was applied between the electrodes and a voltage of 1 kV was then applied to the substrate having the disposed fluorescent member to measure emission current. As a result, it was apparent that the emission current Ie was 1.9±0.5 μA, and thus the scatter of the emission current was smaller than that in comparative example 3 described later where the process was comprised of treatment of applying and calcinating at one time and the same film thickness was obtained, as in the case of the above-mentioned resistance values.

After the evaluation of the electrical properties, the substrate was taken out from the vacuum container, and the fine particle films were observed through a microscope. As a result, a clear-cut crack was observed on the fine particle film substantially in the middle of the electrodes of each device as shown in FIG. 1E.

EXAMPLE 4

In accordance with the present invention, a vertical type surface-conductive electron beam source device was formed as shown in FIGS. 6A through 6D, which comprised five linearly arranged devices. In the figures, 51 and 52 are electrodes, 53 and 54 are fine particle films, 58 is $SiO_2$ layer which provides a difference in level. 59 is a quartz substrate.

Figure 6A:
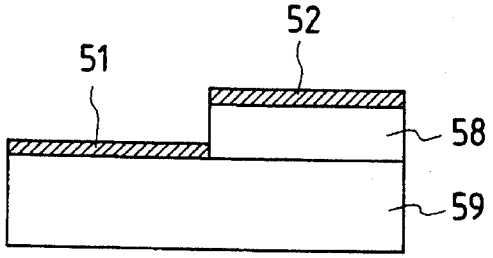
FIGS. 6A through 6D are schematic sectional views illustrating a process of the vertical type surface-conductive electron beam source device of the present invention.
Figure 6B:
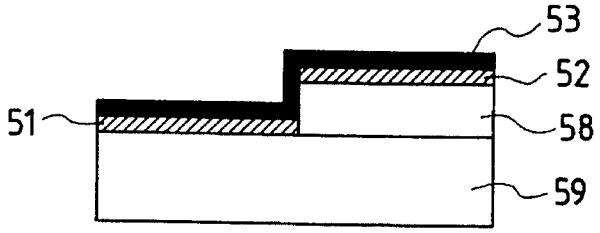

The $SiO_2$ layer 58 having a thickness of 3,000 Å was formed on a quartz substrate, and etching was then carried out with an HF etching solution to form a step on the substrate. Next, a nickel film was formed as thick as 500 Å by a vacuum deposition method using a mask, thereby forming electrodes as shown in FIG. 6A. Afterward, an organic palladium complex solution containing 2.2 g/l of Pd was applied to the above-mentioned substrate in the same manner as in Example 2, followed by calcination at 300° C. for 13 minutes as shown in FIG. 6B.

Figure 6C:
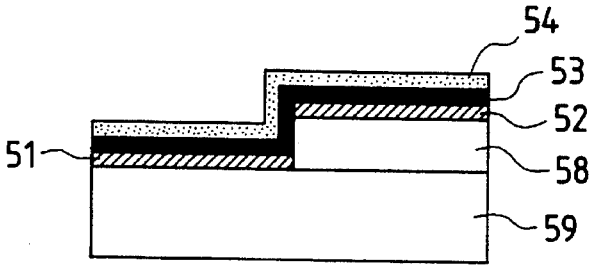

Similarly, an organic palladium complex solution containing 22 g/l of Pd was further applied thereto, followed by calcination at 300° C. for 13 minutes as shown in FIG. 6C.

Figure 6D:
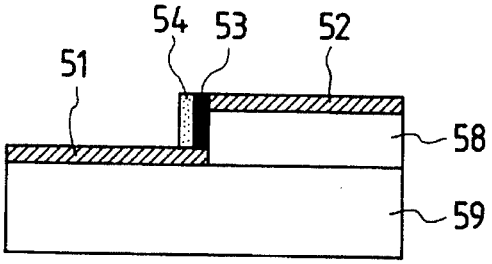

Next, dry etching was carried out using a resist as a mask, to obtain a pattern as shown in FIG. 6D.

In order to evaluate the scatter of the resistance of the thus obtained fine particle films 53, 54, a voltage of 2 V was applied between the electrodes and flowing current was measured. As a result, the resistance values of the five devices were in the range of R=1.5±0.5 kΩ.

Next, a fluorescent member was disposed just above the devices at interval of about 3 mm, and the substrate having them thereon was placed in a vacuum container of about $10^{-6}$ Torr. First, a pulse voltage of 14 V was applied between the electrodes to carry out a forming treatment. Next, in order to inspect electron-emitting properties, a voltage of 14 V was applied between the electrodes and a voltage of 1 kV was then applied to the substrate having the disposed fluorescent member to measure emission current. As a result, it was apparent that the emission current Ie was 3.0±0.5 μA, and thus the scatter of the emission current was smaller than that in comparative example 4 described later where the process was comprised of treatment of applying and calcinating at one time and the same film thickness was obtained, as in the case of the above-mentioned resistance values.

After the evaluation of the electrical properties, the substrate was taken out from the vacuum container, and the fine particle films were observed through a microscope. As a result, a clear-cut crack was observed on the fine particle film substantially in the middle of the electrodes of each device.

EXAMPLE 5

In accordance with the present invention, a plane type surface-conductive electron beam source device as shown in FIG. 2 was formed which comprised five linearly arranged devices. In the present working example, substrate 34 as shown in FIG. 2 is a quartz substrate.

The principal parts of the process of Example 5 is explained in the following, referring to FIGS. 1A through 1E and FIG. 9.

In the first place, a pair of electrodes were formed, by a photolithography technique and a vacuum film formation technique which were usually often used, on a 1 inch×1.5 inch quartz substrate which was sufficiently degreased and washed.

An electrode gap (36 in FIG. 2) was 2 μm, and an electrode width was 300 μm.

The material of the electrodes was 950-Å-thick nickel having a 50-Å-thick chromium under-film, and these electrodes were formed by a vacuum deposition method as shown in FIG. 1A.

An organic palladium complex solution containing 7 g/l of Pd (trade name Catapaste CCP, made by Okuno Chemicals Co., Ltd.) was applied to the above-mentioned substrate by a dipping coat in which the substrate was pulled up at a rate of 5 mm/sec., and calcination was then carried out at 300° C. for 13 minutes as shown in FIG. 1B.

Similarly, the organic palladium complex solution containing 7 g/l of Pd was further applied thereto by dipping coat in which the substrate was pulled up at a rate of 5 mm/sec., and calcination was then carried out at 300° C. for 13 minutes as shown in FIG. 1C.

In addition, the organic palladium complex solution containing 7 g/l of Pd was similarly applied thereto by dipping coat in which the substrate was pulled up at a rate of 5 mm/sec., followed by calcination at 300° C. for 13 minutes.

Next, dry etching was carried out using a resist as a mask, to obtain a pattern as shown in FIGS. 1D and 9. in FIG. 9, numerals 3 and 4 are fine particle film respectively, and 2 is a pair of electrodes.

The thickness of the thus obtained fine particle films was measured by α-step 2 and SEM, and as a result, it was apparent that the films had a uniform thickness of about 74 Å.

In order to evaluate the scatter of the resistance of the thus obtained fine particle films, a voltage of 2 V was applied between the electrodes and flowing current was measured. As a result, the resistance values of the five devices were in the range of R=2.7±0.5 kΩ.

Next, a fluorescent member was disposed just above the devices at interval of about 3 mm, and the substrate having them thereon was placed in a vacuum container of about $10^{-6}$ Torr. First, a pulse voltage of 14 V was applied between the electrodes to carry out a forming treatment. Next, in order to inspect electron-emitting properties, a voltage of 14 V was applied between the electrodes and a voltage of 1 kV was then applied to the substrate having the disposed fluorescent member to measure emission current. As a result, it was apparent that the emission current Ie was 1.9±0.5 μA, and thus the scatter of the emission current was smaller than that in comparative example 3 described later where the process was comprised of treatment of applying and calcinating at one time and the same film thickness was obtained, as in the case of the above-mentioned resistance values.

After the evaluation of the electrical properties, the substrate was taken out from the vacuum container, and the fine particle films were observed through a microscope. As a result, a clear-cut crack was observed on the fine particle film substantially in the middle of the electrodes of each device as shown in FIG. 1E.

EXAMPLE 6

In accordance with the present invention, a multiply arranged plane type surface-conductive electron beam source device (15×3) was formed as shown in FIG. 5.

The principal parts of the process of Example 6 is explained in the following, referring to FIG. 1A through 1E and FIG. 9.

In the first place, a pair of electrodes were formed, by a photolithography technique and a vacuum film formation technique which were usually often used, quartz substrate which was sufficiently degreased and washed.

An electrode gap was 2 μm, and an electrode width was 300 μm.

The material of the electrodes was 950-Å-thick nickel having a 50-Å-thick chromium under-film, and these electrodes were formed by a vacuum deposition method as shown in FIG. 1A.

An organic palladium complex solution containing 10 g/l of Pd (trade name Catapaste CCP, made by Okuno Chemicals Co., Ltd.) was applied to the above-mentioned substrate by dipping coat in which the substrate was pulled up at a rate of 5 mm/sec., and calcination was then carried out at 300° C. for 13 minutes as shown in FIG. 1B. Here, the thickness of the fine particle films was measured by α-step 2, and as a result, it was apparent that the film thickness was about 35 Å.

Similarly, the organic palladium complex solution containing 10 g/l of Pd was further applied thereto by dipping coat in which the substrate was pulled up at a rate of 5 mm/sec., followed by calcination at 300° C. for 13 minutes as shown in FIG. 1C.

Next, dry etching was carried out using a resist as a mask, to obtain a pattern as shown in FIGS. 1D and 9. In FIG. 9, numerals 3 and 4 are fine particle film respectively, and 2 is a pair of electrodes.

The thickness of the thus obtained fine particle films was measured by α-step 2 and a scanning electron microscope (SEM), and as a result, it was apparent that the films had a uniform thickness of about 70 Å.

In order to evaluate the scatter of the resistance of the thus obtained fine particle films, a voltage of 2 V was applied between the electrodes and flowing current was measured. As a result, the resistance values of all the devices were in the range of R=2.8±0.5 kΩ.

Next, a fluorescent member was disposed just above the devices at interval of about 3 mm, and the substrate having them thereon was placed in a vacuum container of about $10^{-6}$ Torr. First, a pulse voltage of 14 V was applied between the electrodes to carry out a forming treatment. Next, in order to inspect electron-emitting properties, a voltage of 14 V was applied between the electrodes and a voltage of 1 kV was then applied to the substrate having the disposed fluorescent member to measure emission current. As a result, it was apparent that the emission current Ie was 1.8±0.5 μA, and thus the scatter of the emission current was smaller than that in comparative example 1 described later where the process was comprised of treatment of applying and calcinating at one time and the same film thickness was obtained, as in the case of the above-mentioned resistance values.

After the evaluation of the electrical properties, the substrate was taken out from the vacuum container, and the fine particle films were observed through a microscope. As a result, a clear-cut crack was observed on the fine particle film substantially in the middle of the electrodes of each device as shown in FIG. 1E.

EXAMPLE 7

Figure 7:
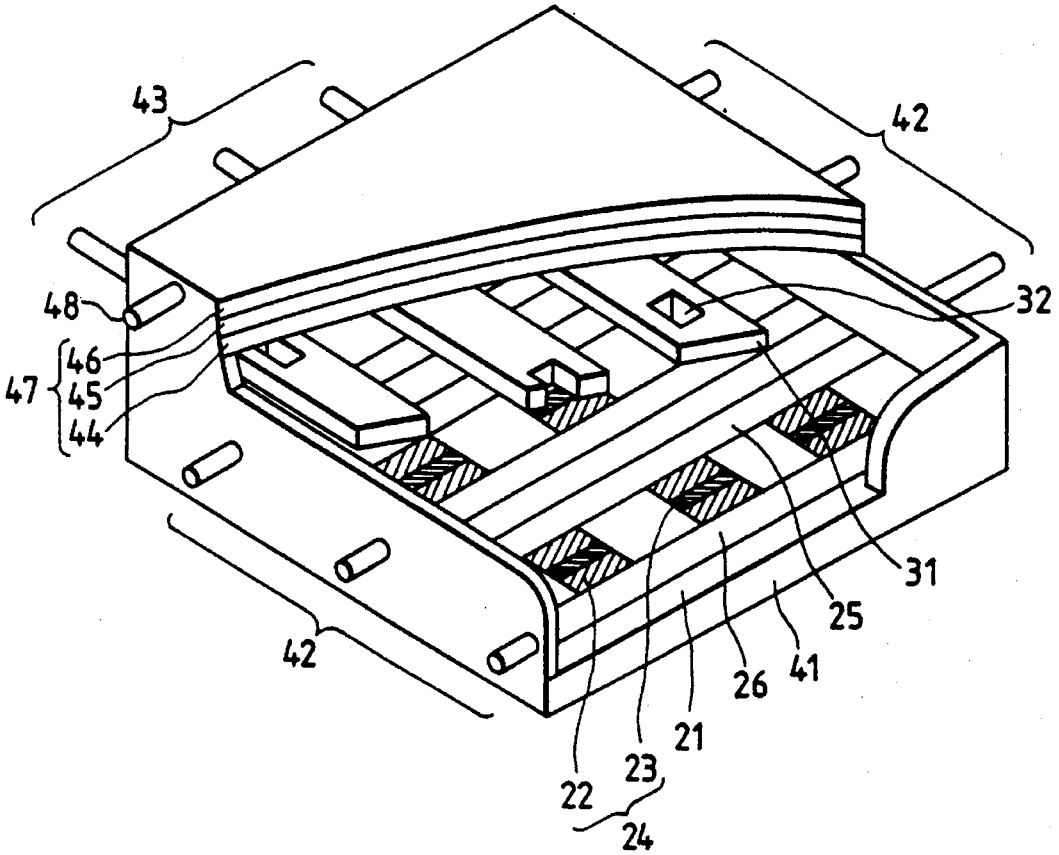
FIG. 7 is schematic constitutional view illustrating one embodiment of the display devices of the present invention.
Figure 8:
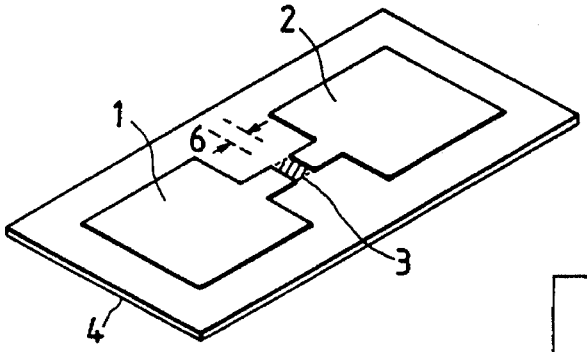
FIG. 8 PRIOR ART
FIG. 8 is a perspective view of illustrating a conventional surface-conductive electron emitting device.

A display device shown in FIG. 7 was prepared by the use of a multiply arranged electron beam source device in Example 1. In this drawing, reference numeral 31 is a modulation means (a grid electrode), 32 is an electron passage orifice, 47 is a face plate, numeral 46 is a glass plate, 44 is a transparent electrode, and 45 is a fluorescent member. A space between the face plate 47 and a rear plate 41 was set to 3 mm.

The above-mentioned display element was driven by the following procedure. A vacuum degree in a panel container constituted by the face plate 47 and the rear plate 41 was set to $10^{-6}$ torr, and voltage across the surface of the fluorescent member was set to 5 through 10 kV through an EV terminal 48. First, a drive voltage of 14 V was applied between a pair of wiring electrodes 25 and 26 through a wire 42. Next, a voltage was applied to a modulation means through a wire 43 in compliance with an information signal to control ON-OFF of electron beam emission. Here, the OFF control of the electron beam could be achieved at −30 V or less, and the ON control could be done at 0 V or more. Furthermore, the electron quantity of the electron beams could be continuously changed between −30 V and 0 V, and gradation display were also possible.

The electron beam corresponding to the information signal emitted by the above-mentioned modulation means collided against the fluorescent member 45, so that one line was displayed in accordance with the information signal on the fluorescent member 45. This operation was similarly carried out by adjacent linear electron-emitting devices in turn, whereby one image could be displayed.

The image displayed by the display device of this example was free from luminance unevenness and sharp. Furthermore, even in the case of a display device having a usual well-known structure, i.e., a face plate of a cathode-ray tube and using a color fluorescent member of R (red), G (green) and B (blue) as the fluorescent member 45, a displayed image was free from luminance unevenness and sharp. The display device of the present working example is disclosed therein as one example of the display devices capable of keeping up with high gradation and color information. However, even if there is a display device of the present invention wherein the modulation means is absent, it is needless to say that such a device can be utilized as a display device.

COMPARATIVE EXAMPLE 1

A multiply arranged plane type surface-conductive electron beam source device was formed in the same manner as in Example 1 except that the application of the organic palladium complex solution containing 20 g/l of Pd and the calcination was carried out only one time only. Resistance value of the fine particle film and electron-emitting property were evaluated in the same manner as therein. The results are shown below:

film thickness=70 Å film resistance=2.8±2.0 kΩ emission current Ie=1.8±1.2 μA

COMPARATIVE EXAMPLE 2

A five linearly arranged plane type surface-conductive electron beam source device was formed in the same manner as in Example 2 except that the application of the organic palladium complex solution containing 24.2 g/l of Pd and the calcination was carried out at only one time. Resistance value of the fine particle film and electron-emitting property were evaluated in the same manner as therein. The results are shown below:

film thickness=81 Å film resistance=2.5±1.5 kΩ emission current Ie=2.0±1.0 μA

COMPARATIVE EXAMPLE 3

A five linearly arranged plane type surface-conductive electron beam source device was formed in the same manner as in Example 3 except that the application of the organic palladium complex solution containing 21 g/l of Pd and the calcination was carried out at only one time. Resistance value of the fine particle film and electron-emitting property were evaluated in the same manner as therein. The results are shown below:

film thickness=74 Å film resistance=2.7±1.8 kΩ emission current Ie=1.9±1.0 μA

COMPARATIVE EXAMPLE 4

A five linearly arranged vertical type surface-conductive electron beam source device was formed in the same manner as in Example 4 except that the application of the organic palladium complex solution containing 24.2 g/l of Pd and the calcination was carried out at one time only. Resistance value of the fine particle film and electron-emitting property were evaluated in the same manner as therein. The results are shown below:

film resistance=1.5±1.0 kΩ emission current Ie=3.0±1.2 μA

What is claimed is:

1. A method for forming a surface-conductive electron beam source comprising the following steps:

(a) forming at least one pair of electrodes on a substrate;

(b) applying an organic metal compound solution between said electrodes, and then calcining the applied organic metal compound to form a fine particle film, and repeating the applying and calcining steps a plurality of times; and (c) applying a voltage to said fine particle film to form an electron-emitting portion.

2. The method for forming a surface-conductive electron beam source according to claim 1, wherein said voltage is a pulse voltage.

3. The method for forming a surface-conductive electron beam source according to claim 1, wherein said organic metal compound solution is an organic palladium complex solution.

4. The method for forming a surface-conductive electron beam source according to claim 1, wherein said organic metal compound solution is an organic platinum complex solution.

5. The method for forming a surface-conductive electron beam source according to claim 1, wherein said organic metal compound solution is an organic ruthenium complex solution.

6. A method for forming an electron-emitting device comprising (a) forming at least one pair of electrodes on a substrate;

(b) applying an organic metal compound solution between said electrodes, and then calcining the applied organic metal compound to form a fine particle film, and repeating the applying and calcining steps a plurality of times; and (c) applying a voltage to said fine particle film to form an electron-emitting portion.

7. The method for forming an electron-emitting device according to claim 6, wherein said organic metal compound solution is an organic palladium complex solution.

8. The method for forming an electron-emitting device according to claim 6, wherein said organic metal compound solution is an organic platinum complex solution.

9. The method for forming an electron-emitting device according to claim 6, wherein said organic metal compound solution is an organic ruthenium complex solution.

10. The method for forming a electron-emitting device according to claim 6, wherein said voltage is a pulse voltage.

11. A method for forming an electron-emitting device providing a fine particle film having an electron-emitting portion, wherein a process of forming said fine particle film comprises:

(a) applying an organic metal compound solution on a substrate; and then calcining the applied organic metal compound to form the fine particle film; and repeating the applying and calcining steps a plurality of times; and (b) applying a voltage to the fine particle film to form an electron-emitting portion.

12. The method for forming an electron-emitting device according to claim 11, wherein said organic metal compound is an organic palladium complex solution.

13. The method for forming an electron-emitting device according to claim 11, wherein said organic metal compound solution is an organic platinum complex solution.

14. The method for forming an electron-emitting device according to claim 11, wherein said organic metal compound solution is an organic ruthenium complex solution.

15. The method for forming an electron-emitting device according to claim 11, wherein said voltage is a pulse voltage.

16. A method for forming a surface-conductive electron beam source providing a fine particle film having an electron-emitting portion, wherein a process of forming said fine particle film comprises:

(a) applying an organic metal compound solution on a substrate; and then calcining the applied organic metal compound to form the fine particle film; and repeating the applying and calcining steps a plurality of times; and (b) applying a voltage to the fine particle film to form an electron-emitting portion.

17. The method for forming a surface-conductive electron beam source according to claim 16, wherein said organic metal compound solution is an organic palladium complex solution.

18. The method for forming a surface-conductive electron beam source according to claim 16, wherein said organic metal compound solution is an organic platinum complex solution.

19. The method for forming a surface-conductive electron beam source according to claim 16, wherein said organic metal compound solution is an organic ruthenium complex solution.

20. The method for forming a surface-conductive electron beam source according to claim 16, wherein said voltage is a pulse voltage.

21. A method of preparing a display device having a electron-emitting device, a modulation means for modulating an electron beam emitted from said electron-emitting device in accordance with an information signal, and an image forming member for forming an image by irradiation of said electron beam, wherein said electron-emitting device is prepared by any one of methods of claims 1, 6, 11 or 16.

* * * * *

UNITED STATES PATENT AND TRADEMARK OFFICE

CERTIFICATE OF CORRECTION

PATENT NO. : 5,597,338

DATED : January 28, 1997

INVENTORS : Kumi Iwai et al.

It is certified that error appears in the above-identified patent and that said Letters Patent is hereby corrected as shown below:

COLUMN 1

Line 41, "with of" should read --with--.

COLUMN 2

Line 14, "irradiaion" should read --irradiation--;
Line 52, "divices" should read --devices--.

COLUMN 4

Line 13, "at or may not" should read --or may not be--;
Line 14, "altered" should read --altered at--.

COLUMN 6

Line 24, "a shown" should read --as shown--.

COLUMN 11

Line 54, "time only." should read --time.--.

UNITED STATES PATENT AND TRADEMARK OFFICE

CERTIFICATE OF CORRECTION

PATENT NO. : 5,597,338

DATED : January 28, 1997

INVENTORS : Kumi Iwai et al.

It is certified that error appears in the above-identified patent and that said Letters Patent is hereby corrected as shown below:

COLUMN 12

Line 64, "comprising" should read --comprising:--.

COLUMN 14

Line 29, "having a" should read --having an--;
Line 34, "any one of methods" should read --the method of any one--.

Signed and Sealed this

Fifteenth Day of July, 1997

Bruce Lehman

*Attest:*

BRUCE LEHMAN

*Attesting Officer*

*Commissioner of Patents and Trademarks*